United States Patent [19]

Greiser

[11] 4,114,164

[45] Sep. 12, 1978

[54] BROADBAND SPIRAL ANTENNA

[75] Inventor: John W. Greiser, Marina del Rey, Calif.

[73] Assignee: Transco Products, Inc., Venice, Calif.

[21] Appl. No.: 751,712

[22] Filed: Dec. 17, 1976

[51] Int. Cl.[2] ..... H01Q 1/36

[52] U.S. Cl. ..... 343/895

[58] Field of Search ..... 343/895

[56] References Cited

U.S. PATENT DOCUMENTS

| | | | |
|---|---|---|---|
| 3,820,117 | 6/1974 | Hall et al. | 343/895 |
| 3,825,933 | 7/1974 | Debski et al. | 343/895 |
| 4,012,744 | 3/1977 | Greiser | 343/895 |

*Primary Examiner*—Alfred E. Smith
*Assistant Examiner*—Harry Barlow
*Attorney, Agent, or Firm*—Charles H. Schwartz

[57] ABSTRACT

A broadband spiral antenna including a tubular member having a planar surface at one end, a planar spiral element supported on the planar surface and radiating outward from a central position on the planar surface to an edge position on the planar surface, and an array of dipole elements supported on and extending around the tubular member and coupled to the planar spiral at the edge position.

18 Claims, 5 Drawing Figures

BROADBAND SPIRAL ANTENNA

The present invention is directed to a broadband spiral antenna and specifically to a broadband spiral antenna including additional antenna elements to extend the low frequency response of a planar, equi-angular or Archimedean spiral antenna element. Specifically, the present invention provides for the extension of the low frequency response of the spiral antenna element by terminating the outer end of the arms of the spiral such as a planar spiral with a series of folded dipoles extending around a cylindrical member.

It is often desirable to try to encompass within a single antenna structure a very broadband frequency response in a relatively small space. For example, radar warning systems have historically been characterized by steadily increasing band widths and ever expanding frequency limits. Since these radar warning systems must exhibit the high probability of intercept over broad frequency ranges, their antennas must provide adequate gain and stable patterns over these wide band widths. In addition, it would be desirable to have only one antenna cover the entire system frequency range. Specifically, it would be desirable to provide for a single antenna structure providing a broad frequency range such as 0.5 to 18 GHz.

One particular design for such a broadband antenna structure has been proposed in an article entitled "New Spiral-Helix Antenna Developed" which article was written by John W. Greiser and Marvin L. Wahl and which appeared in the May/June 1975 issue of Electronic Warfare Magazine. The antenna structure proposed and described in this article included a spiral radiator with a bifilar helix to provide for a circularly polarized antenna to cover the 0.5 to 18 GHz bandwidth in a single antenna structure.

The present invention provides for a single antenna structure to provide for a broadband frequency response and which structure has several advantages over the prior art designs including that described in the article referred to above. Specifically, the antenna structure of the present invention provides for a higher gain and lower VSWR than that proposed in the article in Electronic Warfare Magazine referred to above.

Specifically, the present invention includes a planar, equi-angular or Archimedean spiral antenna element having the outer arms of the spiral terminated with a series of folded dipoles. The dipole structure is designed to produce a backfire radiation pattern over a range from the normal low frequency cutoff of the spiral antenna element to a lower frequency such as two octaves or more below the normal low frequency cutoff of the spiral antenna element.

The spiral element portion of the antenna, which may for example be a planar spiral, operates in a normal fashion above the low frequency cutoff. The dipole arrays do not contribute to the radiation field above the low frequency cutoff of the spiral element because currents on the spiral arms are attenuated to small values by radiation. Therefore, above the low frequency cutoff the dipole structure does not affect the operation of the planar spiral. Near the low frequency cutoff of the planar spiral element both the planar spiral and the dipole structure radiate circularly polarized fields. Low pattern axial ratios are maintained by the antenna because the dipole structure represents a low reflection coefficient to the spiral arm currents, thereby greatly reducing the end effect or reflections from the outer ends of the spiral arms. As the frequency response is reduced further, the spiral element does not provide for any significant radiation and the spiral element functions as a transmission line section to feed the dipole structure. The dipole arrays, therefore, are the main radiators below the normal low frequency cutoff of the spiral antenna.

The present invention therefore provides for a broadband spiral antenna including a spiral element having its outer arms terminated with a series of folded dipoles so as to provide for an increased frequency range and with higher gain and lower VSWR than prior antenna structures.

A clearer understanding of the invention will be had with reference to the following description and drawings wherein.

Figure 1:
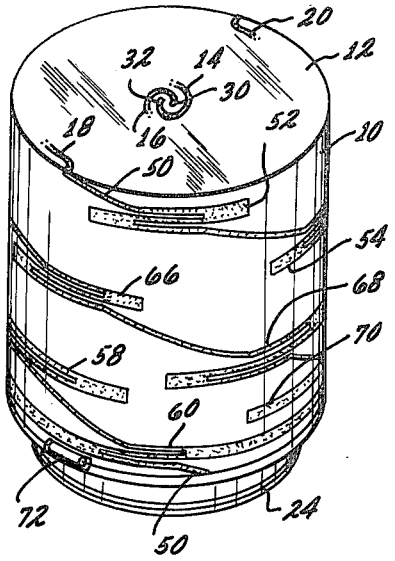
FIG. 1 is a perspective view of the top and one side of the antenna of the present invention.
Figure 3:
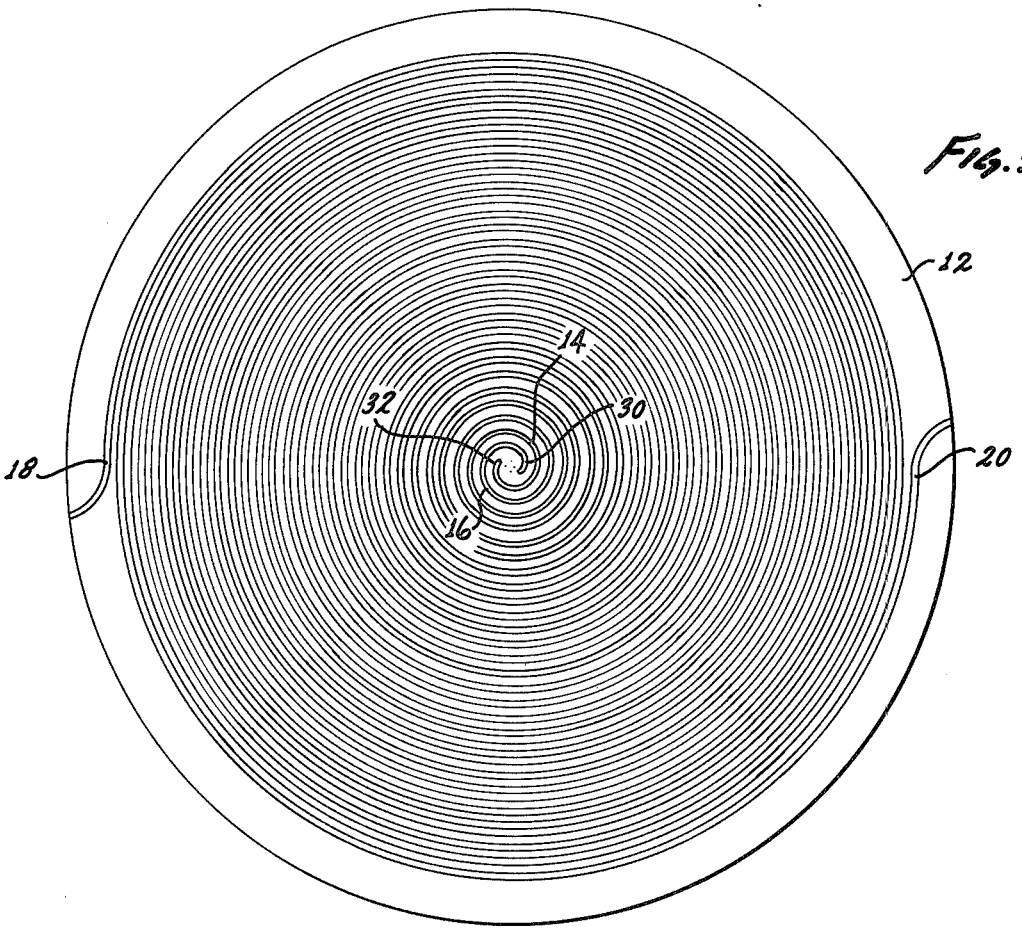
FIG. 3 is a top plan view of the spiral antenna portion of the present invention.

In FIG. 1, a perspective view of the top and one side of the antenna structure is shown and such antenna structure is formed as a cylindrical member 10 closed at both ends to form a cavity. One end of the cylindrical member 10 is closed with a flat plane member 12 supporting a planar spiral having a pair of spiral arms 14 and 16 radiating outward from a center feed portion to outer arm portions 18 and 20. A top view of the planar spiral is shown in FIG. 3 to include the radiating spiral members 14 and 16 and the outer arm portions 18 and 20.

Figure 2:
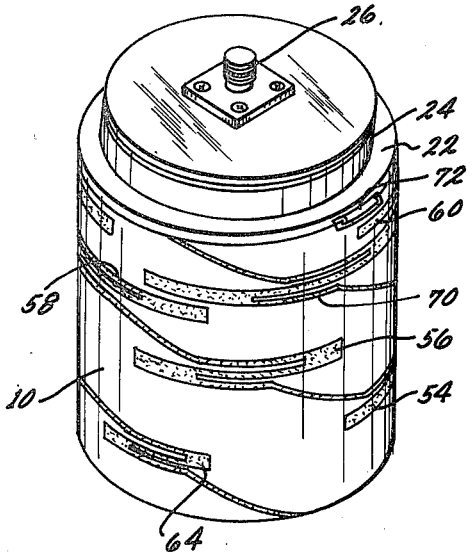
FIG. 2 is a perspective view of the bottom and another side of the antenna of the present invention.
Figure 4:
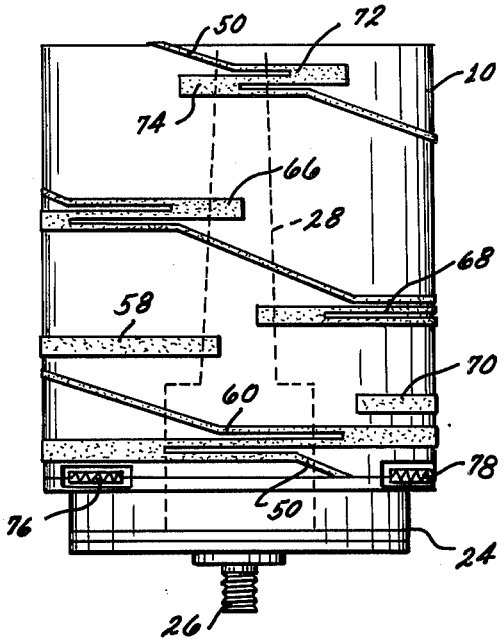
FIG. 4 is a side view of one side of the folded dipole portion of the present invention.

The other end of the cylindrical member 10 as shown in FIG. 2 is also closed by a flat member 22 and extending from the flat member 22 is a short cylindrical portion 24 having a closed end for supporting a coaxial connector 26. A side view of the antenna is shown in FIG. 4 and additionally in FIG. 4 is shown in dotted lines a balun 28 located within the cylindrical members 10 and 24. The balun 28 is used to convert the resistance of the coaxial input connector at the bottom of the antenna structure to a balanced impedance of the proper resistance at spiral feed points at the center of the spirals 14 and 16. The spiral feed points are designated by reference characters 30 and 32 as shown in FIG. 3.

Specifically, the balun may convert the normal 50 ohm coaxial input impedance to a balanced impedance of approximately 120 ohms at the spiral feed points 30 and 32. As shown in FIG. 4, the balun is located along the axis of the cylindrical members 10 and 24 and is contained totally within the cylindrical members. The specific details of the balun form no part of the present invention and it is to be appreciated that any appropriate balun structure or other impedance matching structure may be used.

Figure 5:
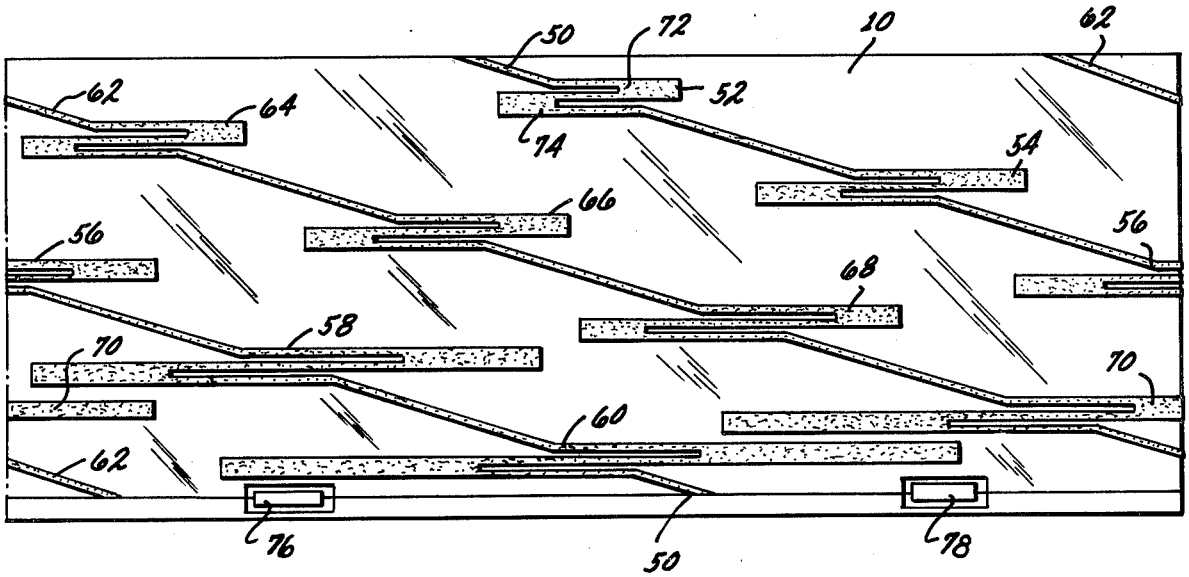
FIG. 5 is a view of the folded dipole portion of the present invention flattened out to show the entire dipole structure.

The cylindrical members 10 and 24 and the plate member 12 are normally formed of dielectric materials and the spiral members 14 and 16 are formed of metallic material. Specifically the spirals 14 and 16 may be formed as a printed circuit on the dielectric plate. Attached to the outer arm portions 18 and 20 of the planar spiral members 14 and 16 are two metallic folded dipole arrays that continue the planar spiral arms along the outer surface of the dielectric cylindrical member 10. Specifically as shown in FIG. 5 the metallic array patterns for the folded dipoles is shown flattened out. In addition, FIGS. 1, 2 and 4 illustrate various side views of portions of the dipole array patterns. The dipole array patterns may be seen to include a first metallic pattern 50 including five folded dipoles 52 through 60 of progressively larger size and extending circumferentially around the cylindrical member 10 along a generally helical path. A second metallic conductor pattern 62 includes four folded dipoles 64 through 70 also extending along a generally helical path circumferentially around the cylindrical member 10.

Generally all of the folded dipoles are of the series type wherein current enters the top of a folded dipole element, follows a path through the dipole element and exits from the lower conductor portion of the dipole element in order to proceed to the next folded dipole element. The lengths of the folded dipole elements increase with the distance from the attachment point to the planar spiral members 18 and 20 so that in a particular example the resonance frequencies of the dipoles range from approximately 1.9 GHz to 0.6 GHz. It can be seen, therefore, that the folded dipoles extend the low frequency range of the planar spiral elements to increase the overall frequency range of the entire antenna structure.

While the lengths of the individual dipoles 52 through 60 and 64 through 70 in the arrays determine the frequencies at which each individual dipole has its maximum radiation, the present invention also includes an independent means to control the phase progression of the dipoles. Generally, in order to provide for a circular polarization radiation pattern from the folded dipoles, it is necessary to have both space (geometric) and phase (time) quadrature. Space quadrature is achieved by disposing the dipole elements around the dielectric cylindrical member 10 in approximately 90° intervals. The phase quadrature is achieved by shorting across the dipole arms symmetrically on either side of the feed points. This phasing technique by shorting across the dipole arms provides for enhanced performance of the present invention. As an example as shown in FIG. 5, the arms of dipole 52 is shorted at points 72 and 74 so that while the current path is shorted the radiation occurs over the entire length of the dipole elements. It can be seen that each folded dipole is shorted in a similar fashion.

The lower ends of the two conductor lines 50 and 62 are terminated by two resistors 76 and 78 which terminate any energy that has not been radiated by the antenna structure. The use of the resistors 76 and 78 improves the radiation pattern and the VSWR performance at the lower end of the range of the frequency band. As shown in the drawings, each resistor 76 and 78 may be disposed in a recess in the dielectric cylindrical member 10. As an alternative, the resistors 76 and 78 may be formed from a resistive material disposed in a plane on the surface of the dielectric cylindrical member 10.

It is to be appreciated that the specific embodiment as described in this application relates to the provision of a frequency range from approximately 0.5 to 18 GHz but that other frequency ranges may be covered by making the overall antenna structure larger or smaller. In addition low frequency patterns and gains can be altered by increasing or decreasing the length of the dipole array. Also different numbers and arrangements of the folded dipole radiators may be used in place of the specific number and arrangement shown in the present application. It is also to be appreciated that other types of dipoles could be used in place of the series fed, folded dipoles shown in the present application. For example, shunt dipoles, folded tripoles, and Windom dipoles could also be used in place of the specific series fed, folded dipoles illustrated. It is also to be appreciated that the present invention may be constructed using printed circuit techniques so that all portions of the structure are formed as a printed circuit structure. In addition, various types of RF absorbing material may be located within the dielectric cylindrical member 10 so as to suppress back radiation from the planar spiral and to prevent reflections from the balun structure 28.

It can be seen, therefore, that the present invention is directed to a broadband antenna structure using a broadband planar spiral element of the Archimedean or equi-angular type coupled to a cylindrical array of series fed dipole elements. The planar spiral radiates a circularly polarized field above its lower cutoff frequency and the cylindrical array radiates a circularly polarized field below the lower cutoff frequency of the planar spiral. The cylindrical array of dipole elements may consist of two sets of series fed, folded dipole elements with the two sets connected to the outer ends of the planar spiral arms. The individual dipole elements of each set may be spaced at approximately 90° intervals around a dielectric tube member supporting the series fed, folded dipole elements and with the dipole elements generally following a helical path from the top of the tube to the bottom of the tube.

Although the invention has been described with reference to particular embodiments, it is to be appreciated that various adaptations and modifications may be made and the invention is only to be limited by the appended claims.

I claim:

1. A broadband spiral antenna, including, a tubular member having a planar surface at one end, a planar spiral antenna portion supported on the planar surface and with the spiral antenna portion spiraling outward from a central position on the planar surface to an edge position on the planar surface, and an array of dipole elements supported on and extending around the tubular member and coupled to the planar spiral antenna portion at the edge position.

2. The broadband spiral antenna of claim 1 wherein the array of dipole elements is an array of series fed, folded dipoles of unequal lengths.

3. The broadband spiral antenna of claim 2 wherein each folded dipole is symmetrically shorted across its arms for providing phase quadrature.

4. The broadband spiral antenna of claim 1 wherein the tubular member is cylindrical and the array of dipole elements extend around the tubular member along a helical path.

5. The broadband spiral antenna of claim 1 wherein the planar spiral antenna portion includes a pair of spiral arms spiraling outward to a pair of edge positions and with a pair of arrays of dipole elements coupled to the spiral arms at the edge positions.

6. The broadband spiral antenna of claim 5 wherein the pair of arrays of dipole elements are each an array of series fed, folded dipoles of unequal lengths.

7. The broadband spiral antenna of claim 6 wherein each folded dipole is symmetrically shorted across its arms for providing phase quadrature.

8. The broadband spiral antenna of claim 5 wherein the tubular member is cylindrical and the pair of arrays of dipole elements extend around the tubular member along a helical path.

9. A broadband antenna, including, a cylindrical member having a closed surface at one end, a spiral antenna portion disposed on the closed surface and spiraling outward from a central position to the circumference of the cylindrical member, and an array of dipole antenna elements coupled to the spiral antenna portion at the circumference and disposed on and extending around the cylindrical member.

10. The broadband antenna of claim 9 wherein the array of dipole antenna elements is an array of series fed, folded dipoles of unequal lengths.

11. The broadband antenna of claim 10 wherein the individual dipole antenna elements are spaced at approximately 90° intervals around the cylindrical member.

12. The broadband antenna of claim 10 wherein each folded dipole is symmetrically shorted across its arms for providing phase quadrature.

13. The broadband antenna of claim 9 wherein the dipole antenna elements extend around the cylindrical member along a helical path.

14. The broadband antenna of claim 9 wherein the spiral antenna portion includes a pair of spiral arms spiraling outward to spaced circumferential positions and with the array of dipole elements formed as two sets of dipole elements and with sets coupled to the spiral arms at the circumferential positions.

15. The broadband antenna of claim 14 wherein each set of dipole elements is an array of series fed, folded dipoles of unequal lengths.

16. The broadband antenna of claim 15 wherein the individual dipole elements in each set are spaced at approximately 90° intervals around the cylindrical member and wherein each set of dipole elements is spaced from the other set of dipole elements.

17. The broadband antenna of claim 16 wherein each set of dipole elements extend around the cylindrical member along a helical path.

18. The broadband antenna of claim 17 wherein each folded dipole element in each set is symmetrically shorted across its arms for providing phase quadrature.

* * * * *